US006681967B2

(12) United States Patent
Cortese

(10) Patent No.: US 6,681,967 B2
(45) Date of Patent: Jan. 27, 2004

(54) METHOD AND DEVICE TO STRETCH SOCKS IN BOARDING MACHINES

(76) Inventor: Carmelo Angelo Cortese, Via della Palazzina, 30, I-40037 Sasso Marconi (IT)

( * ) Notice: Subject to any disclaimer, the term of this patent is extended or adjusted under 35 U.S.C. 154(b) by 0 days.

(21) Appl. No.: 10/009,349

(22) PCT Filed: Apr. 6, 2001

(86) PCT No.: PCT/IT01/00176

§ 371 (c)(1),
(2), (4) Date: Feb. 28, 2002

(87) PCT Pub. No.: WO01/77433

PCT Pub. Date: Oct. 18, 2001

(65) Prior Publication Data

US 2003/0098322 A1 May 29, 2003

(30) Foreign Application Priority Data

Apr. 7, 2000 (IT) ..... BO2000A0204

(51) Int. Cl.[7] ..... A47G 25/90
(52) U.S. Cl. ..... 223/112; 223/75; 223/76
(58) Field of Search ..... 223/75, 76, 112, 223/77

(56) References Cited

U.S. PATENT DOCUMENTS 4,515,299 A * 5/1985 Sewell et al. ..... 223/76
5,706,987 A * 1/1998 Todd et al. ..... 223/76

FOREIGN PATENT DOCUMENTS

EP 0 652 319 A1 5/1995
EP 0 744 487 A2 11/1996

* cited by examiner

*Primary Examiner*—Peter Nerbun
*Assistant Examiner*—James G Smith
(74) *Attorney, Agent, or Firm*—R. Neil Sudol; Henry D. Coleman; William J. Sapone

(57) ABSTRACT

This method is applied in men stocking boarding units including an implement bearing several boarding shapes and suited to be led into a steam boarding chamber defined by two shells, movable with respect to each other into a mutual opening and closing position. The method provides for grasping the stocking inserted on a relevant boarding shape, in correspondence with the cuff of said stocking and on opposing sides of boarding shape itself, inside said boarding chamber, by means of opposing gripping means bound to shells of boarding chamber. Upon boarding unit shells closure, said gripping means are elastically deformed and stretch the stocking leg on the boarding shape to a preset length. The stocking leg is kept stretched during the boarding phase inside the boarding chamber.

16 Claims, 3 Drawing Sheets

FIG. 2
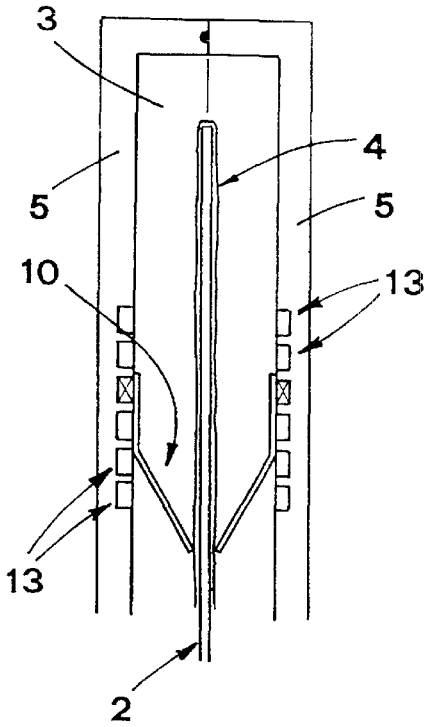
FIG. 3
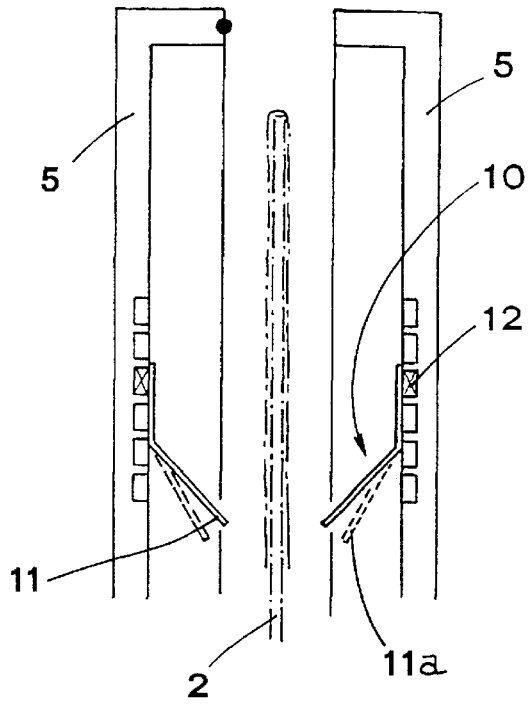
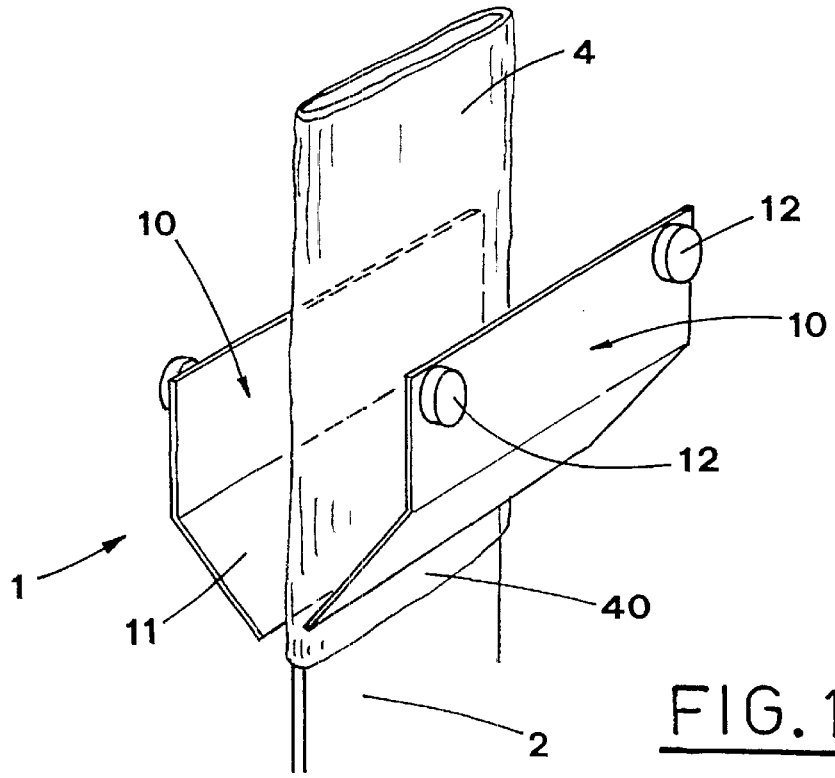
FIG. 1

METHOD AND DEVICE TO STRETCH SOCKS IN BOARDING MACHINES

TECHNICAL FIELD

The subject of this invention is a method to stretch stockings in men stocking boarding units, and a device to implement such method.

BACKGROUND ART

It is known that, during the production phase, stockings undergo several thermal treatments aimed at granting them adequate features. In particular, stockings undergo a boarding treatment that grants them a permanent set. To perform said boarding, stockings are inserted and stretched on special shapes after which they undergo the thermal treatment, for example by means of special pressure steam chambers.

The currently known automatic boarding units for men stockings consist basically of a turntable equipped with special shapes uniformly distributed along the outline of said turntable, on which stockings are inserted and stretched. The turntable's rotation leads the stockings inserted on the shapes into a boarding chamber, for instance of the pressure steam type, and then to a drying chamber. Stockings are then extracted from the boarding shapes and sent to the following packing phases.

Stockings produced with this method never have the same length, even if they are of the same size, due to unavoidable unevenness occurring during the production phase. In particular, said length difference is present in the stocking leg.

It is therefore necessary to gather the output stockings from the boarding unit in homogenous length groups.

Automatic machines called matching machines, which execute the matching of men stockings, usually perform this task. The relevant staff operates a matching machine by feeding it with the stockings to be matched, after having individually taken them from the piles of stockings coming from the earlier production phases. Individual stockings must in fact be placed on a mobile shape of the matching machine, exchangeable according to the size of the machined stockings.

Matching machines have a complex structure and function; therefore their cost is rather high. This cost should obviously be added to that of the employed staff.

To remove this inconvenience, it was devised to employ devices capable of stretching the stockings and to apply such devices to the shapes of the boarding units. In practical terms, these devices consist of a pincer coupled to the boarding shape and capable of grasping the so-called cuff of the stocking placed on the shape itself; the pincer keeps the stocking stretched during the boarding phase in the steam chamber, in order to keep the leg of the stocking stretched to a preset length. When the stocking outputs from the boarding chamber it has a permanent set and therefore maintains the constant length imposed by the stretching device.

Said stretching devices, although based on a correct concept, have never been used in practical terms because their costs are very high as well. In fact, it should be considered that boarding units employ a relatively high number of shapes, for example fifteen or twenty, and that each of these should be duplicated for the number of sizes to be produced, for example about twenty. As each boarding shape requires a stretching device, it is evident that the number of these stretching devices would be rather high.

DISCLOSURE OF INVENTION

The aim of the present invention is to resolve the above-mentioned drawbacks by devising a method allowing to stretch men stockings in the boarding units for these stockings, in order to keep the stocking leg stretched to the preset length in the steam boarding phase and obtain constant length stockings.

Within the scope of this task, this invention is also aimed at providing a device that can implement such method with a simply conceived structure, a surely reliable operation and versatility of use, as well as a relatively low cost.

The mentioned goals are reached with this method for stretching stockings in men stocking boarding units of the type equipped with an implement mounting several boarding shapes on which the relevant stockings should be inserted; said implement is suited to be led into a steam boarding chamber defined by two shells, movable with respect to each other into a mutual opening and closing position. This method is distinguished in that it provides for grasping the stocking inserted on the relevant boarding shape, in correspondence with the cuff of said stocking and on opposing sides of the boarding shape itself, by means of opposing gripping means bound to said shells of the boarding chamber; to cause the elastic deformation of said gripping means upon the closing of said boarding chamber shells, in order to stretch the stocking leg on said boarding shape at a preset length; to keep stretched said stocking leg during the boarding phase, inside said boarding chamber.

BRIEF DESCRIPTION OF DRAWINGS

The details of the invention shall be further evident in the guideline drawings attached, which contain the detailed description of the preferred type of device to stretch stockings in boarding units for men stockings, as follows:

FIG. 1 shows the perspective view of the stretching device for the stockings in subject;

FIGS. 2 and 3 show the cross-section of a steam boarding chamber equipped with such a device, respectively in the shapes closing and opening position.

MODES FOR CARRYING OUT THE INVENTION

Figure 5:
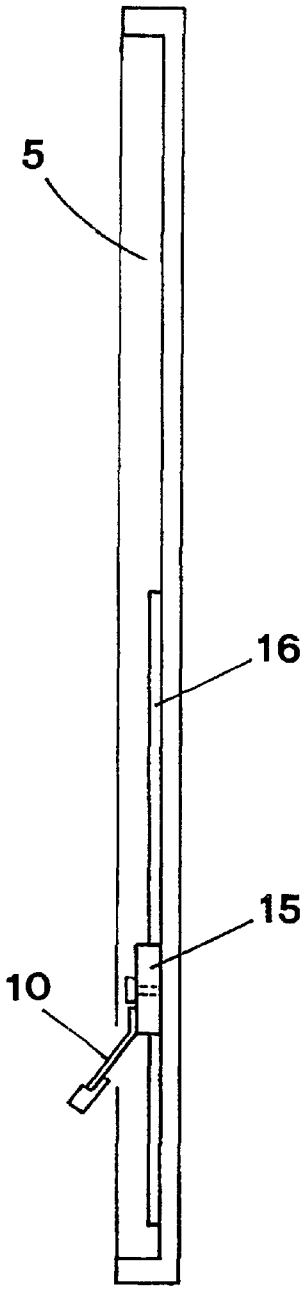
FIGS. 4 and 5 show the front view and the cross-section of said device applied to the relevant shell of said boarding chamber, according to a different construction method.

With particular reference to such figures, 1 indicates as a whole the stretching device for stockings in a boarding unit for men stockings, of the type including an implement mounting several boarding shapes 2, on which respective stockings 4 should be inserted. The implement may be led, with known method into a steam-boarding chamber 3 defined by a pair of shells 5, movable with respect to each other into a mutual opening and closing position.

The device 1 includes opposing gripping means 10 bound to shells 5 of boarding chamber 3, inside said boarding chamber 3, capable of grasping stocking 4 inserted on relevant boarding shape 2, in correspondence with cuff 40 of said stocking 4 and on opposing sides of boarding shape 2 itself.

Gripping means 10 consist of a pair of elastic pincers made from thin metal sheet, equipped with an angle portion 11 that can be elastically deformed upon closure of shells 5 of boarding chamber 3, to stretch the leg of stocking 4 on boarding shape 2, at a preset length. Elastic pincers 10 lock the stocking in proximity of the initial part of cuff 40.

It's possible to arrange elastic pincers 10 so that they are equipped with suitable means capable of improving the grasping of the stockings without ruining them, for example a lining 14 made of teflon-type material fitted on the furthermost part of angle portion 11, locked by means of suitable screws.

Elastic pincers 10 are fitted in an adjustable position on shells 5 of boarding chamber 3, by means of relevant movable attaching means 12. Said attaching means 12 could be, for example, a pair of magnets that can be fitted in an adjustable position in correspondence with a regular series of holes 13 drilled on shells 5.

In practical terms, holes 13 are drilled at different heights inside shells 5, with a constant pitch, in such a way as to allow placing the elastic pincers 10 at different levels with respect to shapes 2, depending on the size of stockings 4.

The stretching method for the stockings therefore provides for grasping stocking 4 inserted on boarding shape 2, in correspondence with cuff 40 of the stocking itself and on opposing sides of shape 2 itself, by means of elastic pincers 10 bound to shells 5, inside boarding chamber 3.

Closure of shells 5 causes the elastic deformation of pincers 10, whose angle portion 11 extends against boarding shape 2 so as to stretch the leg of stocking 4 on shape 2, at a preset length (FIG. 2).

The stocking leg is kept stretched by the elastic pincers 10 during the boarding phase inside boarding chamber 3.

When shells 5 open, at the end of the boarding phase, the stocking has a permanent set and therefore maintains the constant length imposed by elastic pincers 10 of the stretching device. Elastic pincers 10 go back to the resting configuration, as shown in FIG. 3 where the extended configuration of the angle portion 11 during the boarding phase is indicated with 11*a*.

The method in subject therefore succeeds in stretching men stockings in the boarding units for such stockings, in order to keep the stocking leg stretched to the preset length in the steam boarding phase and obtain constant length stockings.

Besides allowing for stocking cuff alignment at the same length, the stretching of the stockings favours the boarding action inside chamber 3.

Figure 4:
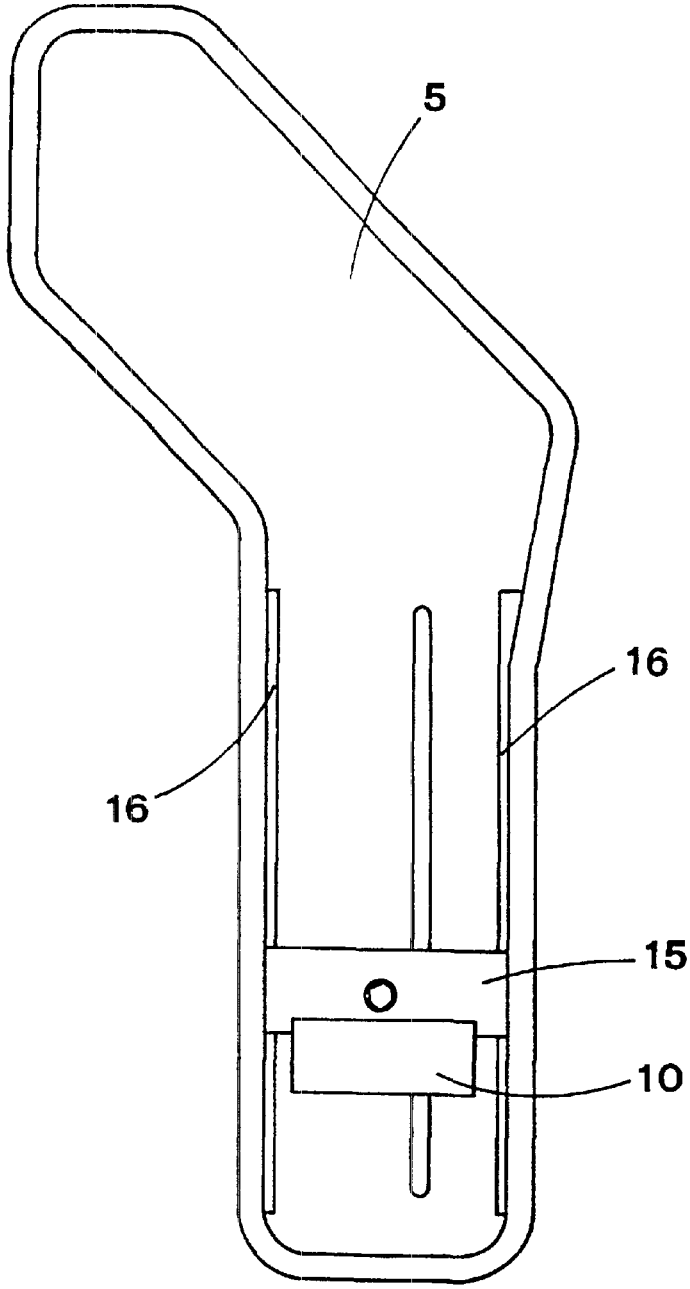

FIGS. 4 and 5 show a specific device construction method that allows performing continuous adjustment of the position of elastic pincers 10. Said elastic pincers 10 are applied on relevant mount 15, which slides on two guides 16 shaped according to shells 5. Mount 15 is locked in the required working position by means of through screw 17, capable of working on the bottom of shell 5. A suitable millimeter rule 18, placed inside shell 5, allows determining the precise position of elastic pincers 10.

By slackening screw 17 it is therefore possible to slide mount 15 of the elastic pincers 10 on vertical guides 10, inside shells 5, in order to place said elastic pincers 10 in the required position, depending on the size of the stockings to be boarded.

Figure 7:
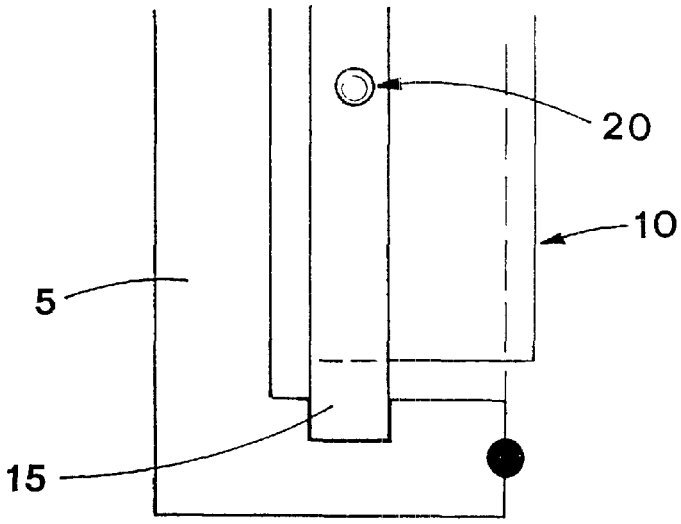
FIGS. 6 and 7 show a partial cross section and transversal section of yet another construction method of the device in subject.
Figure 6:
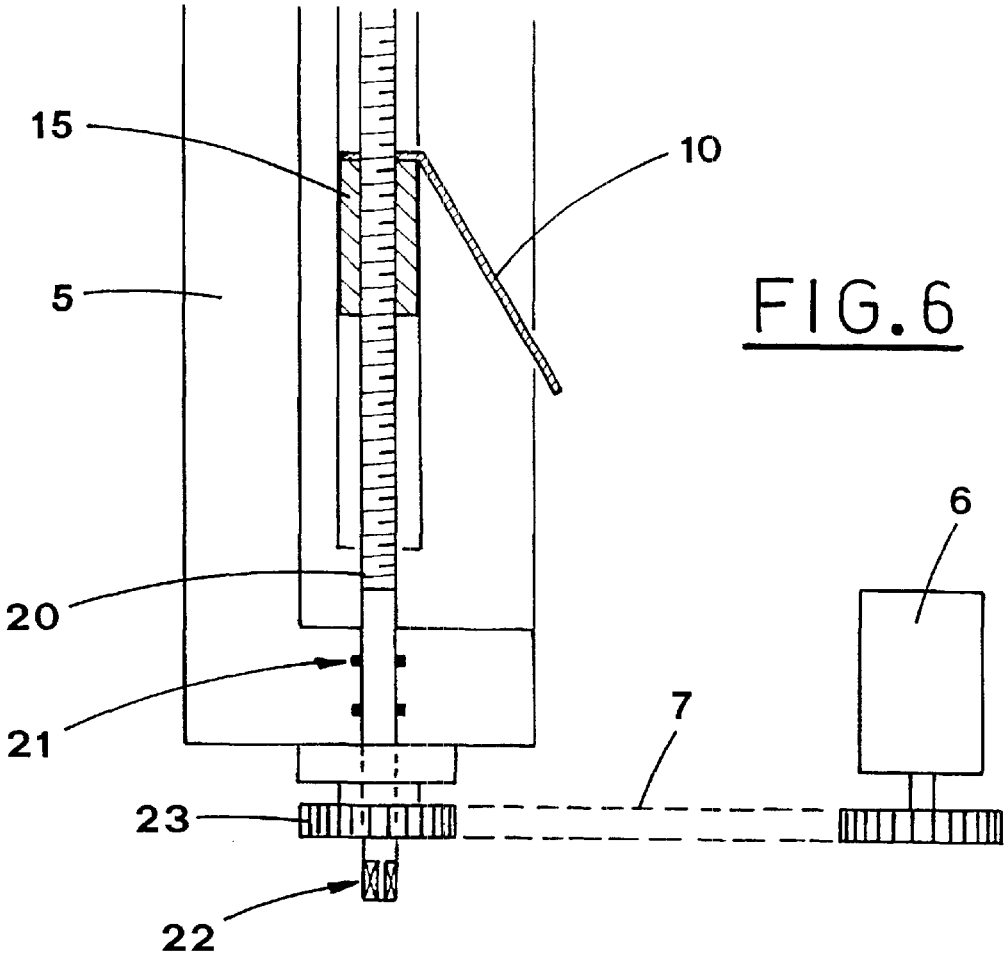

FIGS. 6 and 7 show yet another construction method for the device, which allows adjusting the position of the elastic pincers 10 from outside boarding chamber 3, which is to say when shells 5 are closed. With this purpose the device is equipped with a threaded adjustment shaft 20, placed vertically inside each shell 5 and running through the base of each shell 5, maintaining tightness by means of suitable gaskets 21. On the protruding portion below shell 5, adjustment screw 20 is equipped with a coupling part 22 for a special tool by means of which it is possible to rotate said adjustment screw 20. The adjustment screw 20 engages through a corresponding threaded hole on mount 15 of elastic pincers 10. By rotating adjustment screw 20 it is therefore possible to move mount 15 of elastic pincers 10 on guides 16, inside shells 5, in order to place said elastic pincers 10 depending on the size of the stockings to be boarded.

Alternatively, it-is possible to arrange automatic operation of adjustment screws 20 of elastic pincers 10 by means of respective servomotors 6 operating by means of drive 7 on gear 23, keyed on each adjustment screw 20. Servomotors 6 are integral with respective shells 5, and therefore follow their movement, during opening and closing of boarding chamber 3. Servomotors 6 operate when the format change mode is activated on the display of the boarding unit control panel.

The control of the correct position of elastic pincers 10 in boarding chamber 3 defined by shells 5 is taken care of by the logic program that manages the various functions of the machine.

It should be underlined that the possibility to adjust the position of elastic pincers 10 by acting from outside shells 5 allows acting on said elastic pincers 10 after closing boarding chamber 3. It is therefore possible to further move said elastic pincers 10 after closing boarding chamber 3 to increase or reduce stretch on stockings.

In this regard, it should be noted that different yarns allow different degrees of stretch. In general, the higher is the stretch of the yarns, the higher is the quality of the boarding, and therefore it is convenient to stretch the yarns as much as possible. In practical terms, the device in subject allows reaching the highest stretch possible for each yarn, in order to achieve the best possible boarding.

Obviously, higher yarn stretch implies lower material consumption, for the same length.

Moreover, it should be noted that the described method is achieved by means of an economically convenient and simple device, in terms of both construction and function.

Materials adopted for the actual realization of the invention, as well as their shapes and sizes, can be various, depending on the requirements.

What is claimed is:

1. A method for stretching stockings in men's stocking boarding units of the type equipped with an implement mounting several boarding shapes over which stockings are positioned; said implement being suited to be introduced into a steam boarding chamber defined by two shells, which are movable with respect to each other into a mutuabopening and closing position; said method comprises:

grasping a cuff of a stocking inserted on a respective one of the boarding shapes opposing sides of the respective boarding shape, inside said boarding chamber, by means of opposing gripping means bound to said shells of the boarding chamber and elastically deforming said gripping means upon a closing of said boarding chamber shells, in order to stretch a leg of the stocking on the respective boarding shape to a preset length; to keep the leg of said stocking stretched during a boarding phase, inside said boarding chamber.

2. The method according to claim 1, further comprising adjusting the position of said gripping means on said shells depending on the shape and size of the stockings to be treated.

3. The method according to claim 2, wherein the position of said gripping means on said shells is continuously adjusted by sliding support units of said gripping means along guides vertically placed inside said shells.

4. The method according to claim 2, further comprising automatically adjusting the position of said gripping means by means of drives acting outside said shells.

5. The method according to claim 4, automatically adjusting the position of said gripping means after closing said shells to further move said gripping means to vary the stretch of stockings to be boarded.

6. A device for stretching stockings in men's stockings boarding units of the type equipped with an implement which mounts several boarding shapes over which stockings are positioned; said implement being suited to be introduced into a steam boarding chamber defined by two shells, which are movable with respect to each other into opening and closing positions; characterized in that it includes said device including opposing gripping means bound to said shells inside said boarding chamber, which are capable of grasping a cuff of a stocking disposed on a respective boarding shape, on opposing sides of the boarding shape itself, and which can be elastically deformed upon closure of said shells, in order to stretch a leg of the stocking on said boarding shape to a preset length.

7. The device according to claim 6, wherein said gripping means includes a thin metal sheet equipped with an angle portion that can be elastically deformed to stretch the leg of said stocking.

8. The device according to claim 7, wherein said thin metal sheet has a lining capable of gripping the leg of said stocking, fitted on a furthermost part of said angle portion.

9. The device according to claim 8, wherein said lining is made of plastic and is applied on the furthermost part of said angle portion by means of screws.

10. The device according to claim 6, wherein said gripping means are fitted in an adjustable position on the shells of the boarding chamber, by means of removable attaching means.

11. The device according to claim 10, wherein said attaching means include magnets that can be fitted in an adjustable position in correspondence with a regular series of holes drilled on said shells of said boarding chamber.

12. The device according to claim 6, characterized in that wherein said gripping means are respectively made integral with mounts that can slide on guides which are vertically oriented inside each shell.

13. The device according to claim 12, wherein said mounts can each be fitted in an adjustable working position by means of a respective threaded implement capable of acting on the bottom of at least one of said shells.

14. The device according to claim 12, wherein said mount is connected to a threaded adjustment shaft, vertically coupled with at least one of said shells, which can be rotated to control the movement of said gripping means.

15. The device according to claim 14, wherein said threaded adjustment shaft may be rotated by a drive motor operating by means of gears on the-a side of said threaded adjustment shaft protruding externally from said at least one of said shells.

16. The device according to claim 14, wherein one side of said threaded adjustment shaft protrudes externally from said at least one of said shells and is equipped with connection means for an implement capable of rotating said threaded adjustment shaft.

* * * * *